US005690155A

United States Patent [19]

Millar

[11] Patent Number: 5,690,155

[45] Date of Patent: Nov. 25, 1997

[54] RAIN COVER FOR GOLF BAG AND GOLF CLUBS

[75] Inventor: Thomas D. Millar, Rothesay, Canada

[73] Assignee: Dak Manufacturing, Inc., Canada

[21] Appl. No.: 514,852

[22] Filed: Aug. 14, 1995

[51] Int. Cl.[6] ..... A63B 55/00; A63B 57/00

[52] U.S. Cl. ..... 150/159; 150/160; 206/315.4

[58] Field of Search ..... 150/159, 160; 206/315.3, 315.4

[56] References Cited

U.S. PATENT DOCUMENTS

| | | | |
|---|---|---|---|
| D. 256,293 | 8/1980 | Edwards . | |
| 2,471,169 | 5/1949 | Salzberg et al. | 206/315.4 |
| 2,907,364 | 10/1959 | F.N. Trenery | 150/159 |
| 3,620,276 | 11/1971 | Taylor | 150/159 |
| 3,754,587 | 8/1973 | Rainieri | 150/159 |
| 4,234,025 | 11/1980 | Berge . | |
| 4,498,579 | 2/1985 | Brick | 206/315.4 |
| 4,699,164 | 10/1987 | Pilney et al. | 206/315.4 |
| 4,752,004 | 6/1988 | Very | 150/159 |
| 4,953,697 | 9/1990 | Stanley | 206/315.4 |
| 5,005,623 | 4/1991 | Webster, Jr. | 150/159 |
| 5,024,259 | 6/1991 | Treadway | 150/159 |
| 5,131,442 | 7/1992 | Bevier | 150/159 |
| 5,146,967 | 9/1992 | Chapman | 150/159 |
| 5,220,950 | 6/1993 | Cordasco | 150/159 |
| 5,280,798 | 1/1994 | Helm | 150/159 X |
| 5,390,717 | 2/1995 | Schenker et al. | 150/159 |

*Primary Examiner*—Sue A. Weaver

*Attorney, Agent, or Firm*—Wigman, Cohen, Leitner & Myers, P.C.

[57] ABSTRACT

There is provided a new and useful golf bag cover for the improved protection of a golf bag and its contents from rain and like precipitation. The cover is made up of first and second flexible planar sheets, each of elongated and preferably generally rectangular configuration. The first sheet has a top and a bottom portion while the second sheet also has a top and a bottom portion but the top portion extends beyond the top portion of the first sheet. The second sheet is further provided with an overlapping pair of flaps at an upper area of the second sheet extending downwards over the top portion of the first sheet. The first and second sheets are fastened substantially continuously along a side edge of each of said sheets.

23 Claims, 2 Drawing Sheets

RAIN COVER FOR GOLF BAG AND GOLF CLUBS

BACKGROUND OF THE INVENTION

The present invention relates to a cover for a golf bag and golf clubs which can be readily placed over the bag and clubs to protect the bag and clubs from rain and other precipitation. The cover is provided with overlapping flaps to allow individual clubs to be extracted and replaced without difficulty and without exposing the bag or other clubs to the precipitation.

Rain is a common problem to golfers. The need to keep both the bags and the golf clubs dry and protected from the weather is a common difficulty for golfers who find themselves out on the course when a sudden rain shower starts, or indeed for those who choose to play through a constant drizzle or shower.

Many of the golf club covers currently in use do not provide the required protection in an efficient, easy-to-use, inexpensive and convenient manner. Many of the existing covers are too bulky to be conveniently carried in a golf bag or require the golfer to use a series of zippers, snaps or other mechanical fasteners to access the clubs while the cover is in place. Other existing covers simply provide a "hole" in the plastic cover through which to access the clubs. While this provides easy access, it allows the clubs and the bag to get wet while a club is being extracted from the bag. Thus, the cover has only limited usefulness. Reference is made for example to U.S. Pat. No. 2,907,364 of Trenery, issued Oct. 6, 1959; U.S. Pat. No. 3,620,276 of Taylor, issued Nov. 16, 1971; U.S. Design Pat. No. 256,293 of Edwards, issued Aug. 12, 1980; U.S. Pat. No. 4,234,025 of Berge, issued Nov. 18, 1980; U.S. Pat. No. 5,024,259 of Treadway, issued Jun. 18, 1991; and U.S. Pat. No. 5,220,950 of Cordasco.

SUMMARY OF THE INVENTION

In one aspect of the invention there is provided a golf bag cover for the improved protection of a golf bag and its contents from rain and like precipitation. The cover is made up of first and second flexible planar sheets, each of elongated and preferably generally rectangular configuration. The first sheet has a top and a bottom portion while the second sheet also has a top and a bottom portion but the top portion extends beyond the top portion of the first sheet. The second sheet is further provided with an overlapping pair of flaps at an upper area of the second sheet extending downwards over the top portion of the first sheet. The first and second sheets are fastened substantially continuously along a side edge of each of said sheets.

In a preferred embodiment of the invention, the cover is made of a transparent material.

In another preferred embodiment of the invention, the flaps overlap by a substantial amount, generally greater than one half of the width of one of the flaps.

The flaps may also be provided with a hook and loop closure means to releasably secure one flap to the other.

The flaps and the top portion of the second sheet may be joined together by means of an ultrasonic weld.

In a most preferred embodiment of the invention, the flaps and the top portion of the second sheet may be joined together by a plurality of ultrasonic weld spots.

The cover of the present invention thus provides a means of protecting a golf bag and golf clubs from rain and similar precipitation. The cover's generally tubular design allows for easy use of the cover without the need for snaps or similar mechanical fasteners. The cover's overlapping flaps provide for easy access to the clubs and the contents of the golf bag while at the same time minimizing or preventing entry of precipitation into the bag.

BRIEF DESCRIPTION OF THE DRAWINGS

These and other advantages of the invention will become apparent upon reading the following detailed description and upon referring to the drawings in which.

Figure 1:
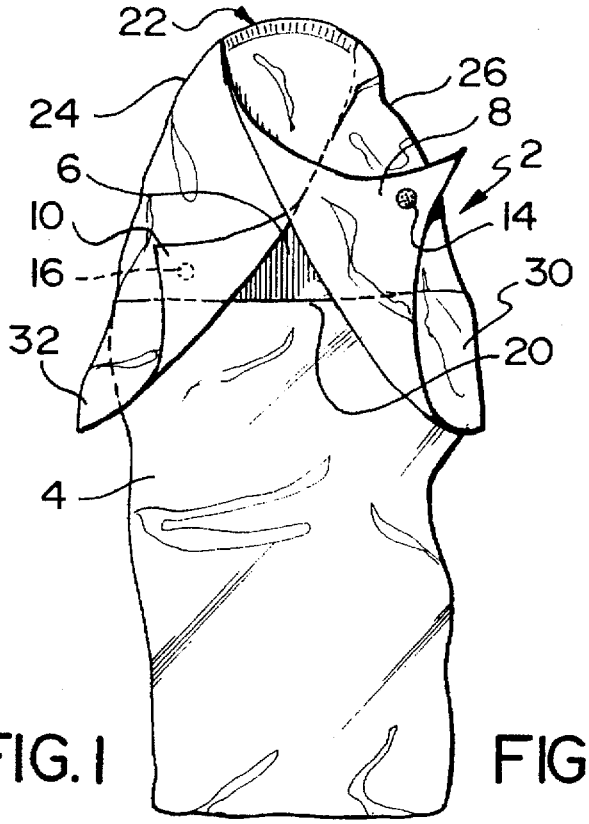
FIG. 1 is a front view of the cover showing the flaps in an open position.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

In the following description, similar features in the drawings have been given similar reference numerals.

Turning to the drawings, FIG. 1 shows a rain cover 2 comprising first 4 and second 6 sheets and a pair of overlapping flaps 8 and 10. The overall configuration is that of a sleeve with a flapped top closure.

The overlapping flaps 8 and 10 are provided with closure means 12 preferably comprising a first part 14 on flap 8 and a second part 16 on flap 10, the parts 14 and 16 mating when the use of the closure means 12 is desired. In a preferred embodiment, the closure means 12 comprises a hook and loop fastener, with parts 14 and 16 bonded ultrasonically to flaps 8 and 10 respectively.

Figure 4:
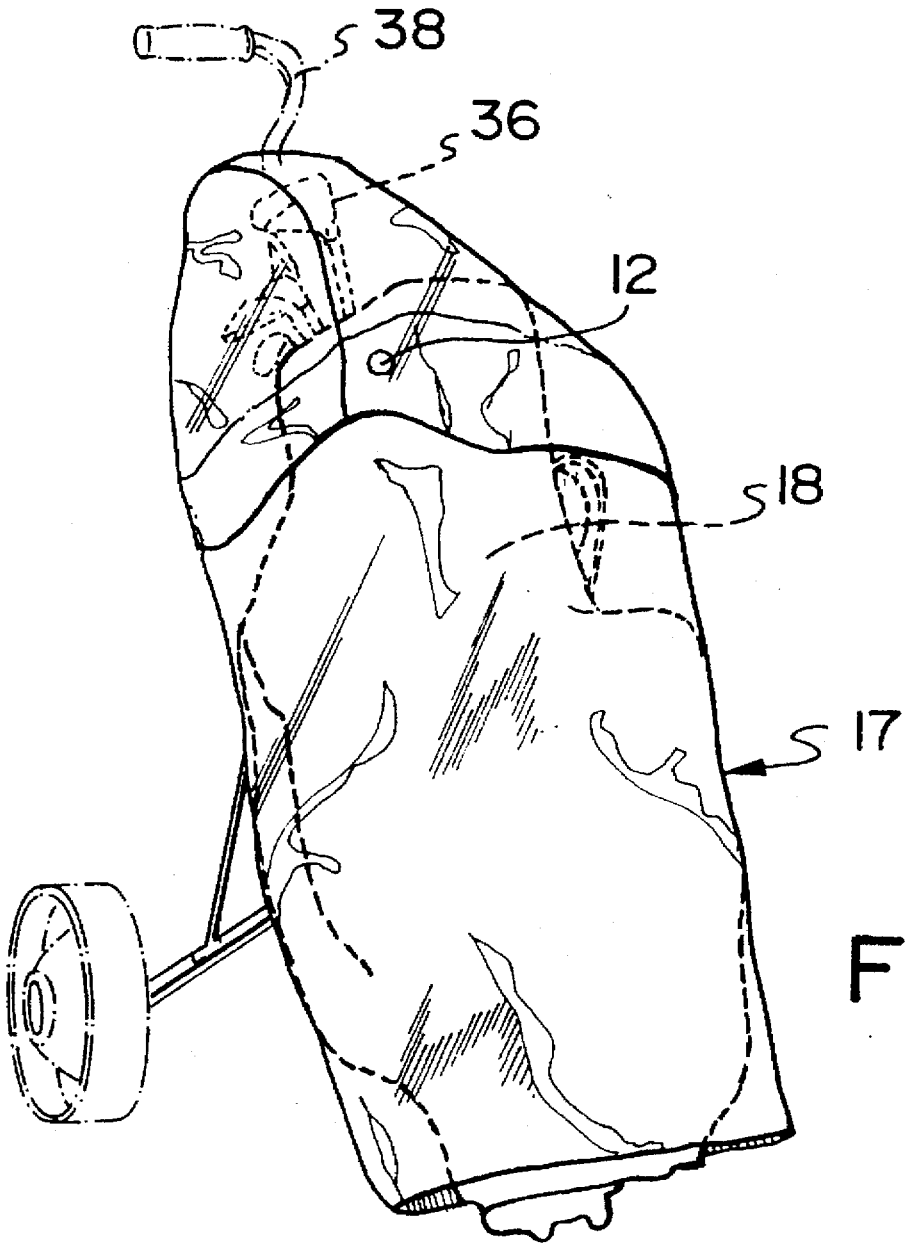
FIG. 4 is a perspective view of the rain cover in use over a golf bag while the latter is mounted on a conventional golf pull-cart.

The body 17 of the rain cover 2, comprised of first 4 and second 6 flexible sheets protects the main portion of the golf bag 18 (shown in phantom in FIG. 4). In the use position, the top edge 20 of first sheet 4 is substantially below the top edge 22 of second sheet 6.

In one preferred embodiment of the invention, the sheets 4 and 6 are joined substantially continuously along respective side edges of each sheet by means of a continuous heat seal.

As illustrated most clearly in FIG. 1, the flaps 8 and 10 are joined continuously along edges 24 and 26 respectively of second sheet 6 between top edge 20 of first sheet 4 and top edge 22 of second sheet 6 by means of a thermal impulse seal.

In one preferred embodiment, the flaps 8 and 10 are further joined to the upper area of the second flexible sheet 6 by means of a continuous ultrasonic weld 28. As the top of the cover is a key stress point, this seal provides the strength required for the flaps 8 and 10 to be repeatedly opened and closed relative to one another and the second sheet 6. In addition, the weld 28 tends to hold the flaps 8 and 10 in a closed position, even where the closure means 12 is not present, or not engaged. This lessens the need for reliance on mechanical fasteners, and increases the protection the cover provides from rain and the like, even in strong winds. Further, this tendency allows the closure means 12 to be easily engaged.

Between edge 20 and the ends of weld 28, flaps 8 and 10 are preferably joined to second sheet 6 by a thermal impulse seal. The bottom parts 30 and 32 of flaps 8 and 10 overlap top edge 20 of first sheet 4 by a substantial amount, typically about 20 cm. Similarly, flaps 8 and 10 overlap each other in central area 34 by a substantial amount, again typically 20 cm. This in a typical case would be an overlap of about one-half the width of each flap, such that in FIG. 2 the "a" of the overlap would be preferably at least one half the width "b" of the flaps 8 and 10. Similarly, overlap in "c" in FIG. 3 is preferably approximately equal to "a".

Figure 2:
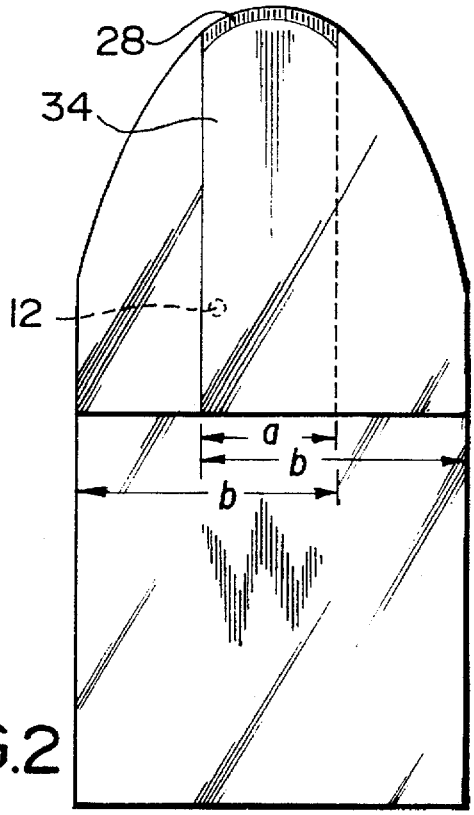
FIG. 2 is a front plan view of the cover with the flaps in the closed position.

As most clearly illustrated in FIG. 2, in one preferred embodiment of the invention, the second sheet 6 and the flaps 8 and 10 are formed to have generally arcuate top edges 22, 24, and 26. This has the obvious advantage of conforming to the generally arcuate shape resulting from the clubs 36 within the golf bag 18, as illustrated in FIG. 4.

Figure 3:
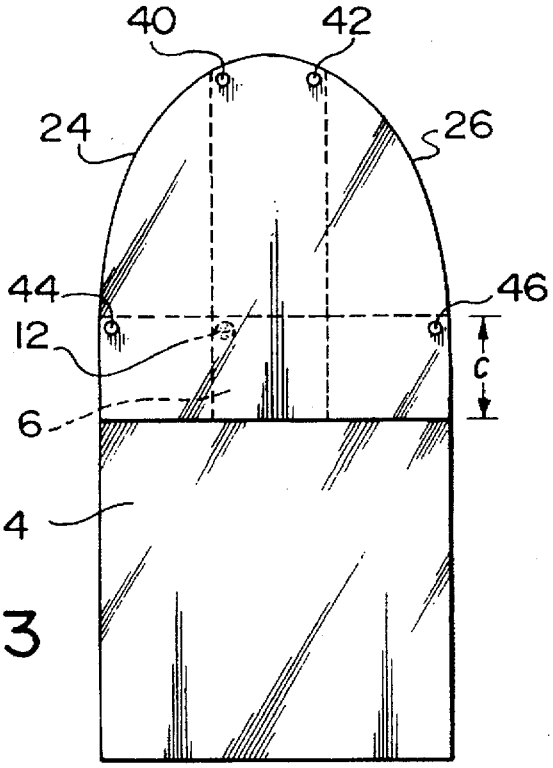
FIG. 3 is a front plan view of a preferred embodiment of the cover with the flaps in the closed position.

In a most preferred embodiment as illustrated in FIG. 3, the ultrasonic weld 28 has been replaced by ultrasonic weld spots 40, 42, 44, and 46, located at specific stress points. Of note, spots 44 and 46 penetrate both sheets 4 and 6 and respective flap 8 or 10. In this configuration, the desirable properties of the weld 28, as more particularly described above, are maintained and the risk of shearing or tearing at edge 24 or 26 is further reduced. In this embodiment the thermal impulse seal is maintained continuously between top edge 20 of first sheet 4 and top edge 22 of second sheet 6.

With reference to FIG. 4, the cover 2 is illustrated in place over a golf bag 18 (shown in phantom), which in turn is mounted on a conventional golf pull-cart 38. The cover 2 as illustrated has been adapted to assume a generally cylindrical configuration while in use to best cover the bag 18 and its contents. As can be seen from the illustration, the cover 2 is easily placed in position by simply slipping it over the bag 18 and its contents prior to strapping the bag 18 onto the cart 38 in conventional fashion. The cover 2 is equally readily useable with a conventional motorized cart (not illustrated).

Again with reference to FIG. 4, the flaps are illustrated held in the closed position by closure means 12 thus protecting the bag 18 and the golf clubs 36 (shown in phantom) from precipitation and the like. From this position, the clubs 36, and the bag 18, are readily accessible while the cover 2 is in place. Either, or both, of the flaps 8 and 10 may be drawn back relative to the other, as shown in FIG. 1, thus providing access to the clubs 36, or the contents of the bag, while the bag 18 is in place on the cart 38. The obvious benefit illustrated in this drawing is that the remainder of the clubs 36 and the contents of the bag 18 are protected from precipitation while one club is easily and quickly extracted for use by the golfer.

Since many golf bags differ from one another, the cover 2 is adaptable to many different sizes and shapes by virtue of its flexibility and general configuration. Storage space in a golf bag is typically at a premium. Therefore, the shape and construction of the cover 2 is such that it may also be folded practically flat (not shown) when not in use to facilitate its storage within the golf bag 18.

In a preferred embodiment of the invention, the first 4 and second 6 sheets and the flaps 8 and 10 are extruded in a blown film process. Thus, the body 17 of the cover 2 is fashioned into "J" film which is a desirable form to achieve flexographic line or process printing. While "J" film is known to the plastic film industry, its incorporation in the design of a golf bag cover is novel and represents a significant improvement over previous covers designed to accept printing.

A preferred material for the cover is AFFINITY (trademark) polyolefin plastomer, produced by Dow Chemical, which has many of the characteristics of polyvinyl chloride (PVC). Unlike vinyl, however, it can be heat sealed to produce strong seals. This is an important factor in avoiding the mechanical joinery of prior art covers. The present cover utilizes design features which take full advantage of the thermoplastic characteristics of the material.

Thus, it is apparent that there has been provided in accordance with the invention a cover for a golf bag and golf clubs that fully satisfies the objects, aims and advantages set forth above. While the invention has been described in conjunction with an example embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention is:

1. A golf bag cover comprising first and second flexible planar sheets, each of elongated configuration; the first sheet having a top edge, side edges and a bottom portion; the second sheet having a top edge, side edges and a bottom portion, said top edge of said second sheet located beyond the top edge of the first sheet; the second sheet provided with a pair of flaps substantially continuous with said top edge and upper parts of said side edges of said second sheet and extending downwards to overlap said top edge of said first sheet and transversely overlapping each other at said top edge continuously along their length so that said flaps tend to remain in a closed overlap position; the first and second sheets fastened together substantially continuously along side edges of each of said sheets.

2. A golf bag cover as in claim 1 wherein the flexible sheets are transparent.

3. A golf bag cover as in claim 1 wherein the flexible sheets are of generally rectangular configuration.

4. A golf bag cover as in claim 1 wherein the top edge of the second sheet is of generally arcuate configuration.

5. A golf bag cover as in claim 1 wherein the flaps overlap over a centre part of the first sheet.

6. A golf bag cover as in claim 1 wherein the pair of flaps overlap each other to a substantial extent.

7. A golf bag cover as in claim 1 wherein the pair of flaps overlap by at least one half the width of one of said pair of flaps.

8. A golf bag cover as in claim 1 wherein said first and second sheets and the flaps are fastened together by means of a thermal impulse seal.

9. A golf bag cover as in claim 8 wherein a portion of said thermal impulse seal is replaced so that a part of the pair of flaps and the top edge of the second sheet are further joined by means of a continuous ultrasonic weld.

10. A golf bag cover as in claim 8 wherein the pair of flaps and the second sheet are further joined by means of a plurality of ultrasonic weld spots.

11. A golf bag cover as in claim 1 wherein the first sheet, the second sheet and the pair of flaps are extruded in a blown film process to achieve a desirable form for flexographic line or process printing.

12. A golf bag cover as in claim 1 wherein the pair of flaps are provided with closure means for releasably affixing one of said pair of flaps to the other of said pair.

13. A golf bag cover as in claim 12 wherein the closure means comprises a hook and loop fastener.

14. A golf bag cover comprising first and second transparent flexible planar sheets, each of elongated, generally rectangular configuration; the first sheet having a top edge, side edges and a bottom portion; the second sheet having an arcuate top edge, side edges and a bottom portion, said top edge of said second sheet located beyond the top edge of the first sheet; the second sheet having an overlapping pair of flaps continuously joined with said top edges and upper parts of the side edges of the second sheet and extending downwards over the top edge of the first sheet, said pair of flaps overlapping each other transversely to a substantial extent at said top edge and continuously along their length so that said flaps tend to remain in the closed overlap position; the first and second sheets fastened together substantially continuously along respective side edges by means of a thermal impulse seal; the pair of flaps provided with a closure means for releasably affixing one of said flaps to the other; the pair of flaps and the top edge and an upper part of the side edges of the second sheet further joined by means of a plurality of ultrasonic weld spots.

15. A golf bag cover comprising a sleeve comprised of a front panel, and a back panel extending above the front panel, said back panel provided with a pair of flaps substantially continuously joined with an upper edge of the back panel, said flaps extending downwards over a top edge of the front panel and transversely overlapping each other continuously along their length so that said flaps tend to remain in the closed overlap position.

16. A golf bag cover as in claim 15 wherein the sleeve is adapted to assume a generally cylindrical configuration in use.

17. A golf bag cover as in claim 15 wherein the sleeve is comprised of a transparent material.

18. A golf bag cover as in claim 15 wherein a top edge of the back panel is of generally arcuate configuration.

19. A golf bag cover as in claim 15 wherein the pair of flaps overlap by at least one half the width of one of said pair of flaps.

20. A golf bag cover as in claim 15 wherein the pair of flaps are further joined to the back panel by means of an ultrasonic weld.

21. A golf bag cover as in claim 15 wherein the sleeve and the pair of flaps are extruded in a blown film process to achieve a desirable form for flexographic line or process printing.

22. A golf bag cover as in claim 15 wherein the pair of flaps are provided with closure means for releasably affixing one of said pair of flaps to the other of said pair.

23. A golf bag cover as in claim 22 wherein the closure means comprises a hook and loop fastener.

* * * * *